US008657142B2

(12) United States Patent
Wolfe et al.

(10) Patent No.: US 8,657,142 B2
(45) Date of Patent: Feb. 25, 2014

(54) TANK WITH INTERNAL BAFFLE

(75) Inventors: Ronald A. Wolfe, Indianapolis, IN (US); Andrew J. Sander, New Whiteland, IN (US)

(73) Assignee: Advantage Engineering, Inc., Greenwood, IN (US)

( * ) Notice: Subject to any disclaimer, the term of this patent is extended or adjusted under 35 U.S.C. 154(b) by 0 days.

(21) Appl. No.: 13/424,766

(22) Filed: Mar. 20, 2012

(65) Prior Publication Data

US 2013/0248535 A1 Sep. 26, 2013

(51) Int. Cl.
*B65D 25/04* (2006.01)
*B65D 8/08* (2006.01)

(52) U.S. Cl.
USPC ..... 220/533; 220/500; 220/501; 220/529; 220/532; 220/563; 220/564; 220/651; 220/661; 220/676

(58) Field of Classification Search
USPC ..... 220/563, 532, 533, 501, 500, 529, 562, 220/564, 656, 553, 653, 651, 510, 541, 542, 220/543, 544, 549, 661, 676
See application file for complete search history.

(56) References Cited

U.S. PATENT DOCUMENTS

| | | | | | |
|---|---|---|---|---|---|
| 2,034,030 | A * | 3/1936 | Gaugler | 62/329 |
| 3,710,974 | A * | 1/1973 | Hage | 220/541 |
| 4,301,942 | A * | 11/1981 | Kupperman et al. | 220/592.17 |
| 4,346,813 | A * | 8/1982 | Cho et al. | 220/532 |
| 5,407,091 | A * | 4/1995 | Wallis | 220/565 |
| 6,375,033 | B1 * | 4/2002 | Fleming | 220/713 |
| 6,871,921 | B2 * | 3/2005 | Ernst | 312/348.3 |
| 7,121,407 | B2 * | 10/2006 | Hurt et al. | 206/373 |
| 7,946,445 | B2 * | 5/2011 | Tytar | 220/501 |

* cited by examiner

*Primary Examiner* — Anthony Stashick
*Assistant Examiner* — Jennifer Castriotta
(74) *Attorney, Agent, or Firm* — Woodard, Emhardt, Moriarty, McNett & Henry LLP

(57) ABSTRACT

A tank for holding liquid having internal partitions. The partitions have enlarged bottom ends fillable with liquid and restable on the bottom wall of the tank to limit sideways movement of the partitions. The partitions are mounted to the tank only above the liquid within the tank by a channel that loosely receives the top ends of the partition.

9 Claims, 4 Drawing Sheets

TANK WITH INTERNAL BAFFLE

BACKGROUND OF THE INVENTION

1. Field of the Invention

The present invention relates generally to the field of tanks for holding liquid and having baffles mounted therein.

2. Description of the Prior Art

Liquid tanks are known that have internal baffles or partition walls for dividing the interior tank cavity into multiple compartments. The partitions have top ends secured to bracketry, in turn, secured to the tank side wall. Likewise, the bottom portions of the partitions are secured to brackets, in turn, secured to the side walls.

Several problems exist with the prior tanks having internal partitions. First, the bracketry used to secure the partition to the tank side wall requires compromise of the integrity of the side wall in that fasteners extend through the side wall to secure the partition bracket to the side wall. Alternatively, the partition bracket may be extended through the tank side wall and then secured thereto by fasteners located outwardly of the side wall. It is therefore possible for liquid to seep through the side wall at the location of the bracket and fastener. The second major problem is assembling the partitions, brackets and fasteners within the tank. In many cases, the tanks are large requiring an assembler to crawl in the tank and assemble the components one by one until the brackets and partitions are secured to the tank side wall. Existence of the partition reduces the area for the person assembling the components thereby adding to the complexity.

Disclosed herein is a partition that may be dropped into the tank cavity and secured only to the tank side wall by components located above liquid level thereby preventing compromise of the tank side wall and preventing leakage. Further, the partition includes a flared bottom end that is hollow allowing liquid within the tank to flow into the partition adding to the stability of the partition and limiting sideways movement of the partition flared bottom end relative to the tank. In addition, a channel mounted at the top of the tank cavity loosely engages the top end of the baffle, allowing limited movement thereof.

SUMMARY OF THE INVENTION

One embodiment of the present invention is a tank with internal baffle that comprises a main body including a bottom wall and a side wall connected together forming an internal tank cavity. A baffle wall has a top end and an enlarged flared bottom portion resting atop the tank bottom wall to limit sideways movement of the baffle wall atop the bottom wall. A holding support is secured to the side wall and the top end of the baffle wall limiting sideways movement of the top end relative to the side wall.

It is an object of the present invention to provide a tank for holding liquid having an interior baffle or baffles wherein leakage through the tank side wall is prevented as a result of any connection with the tank to the baffle or baffles.

A further object of the present invention is to provide a tank having an internal baffle or baffles that can be easily and quickly assembled without requiring assembly of components to stabilize the bottom end of the baffle.

Related objects and advantages of the present invention will be apparent from the following description.

DESCRIPTION OF THE PREFERRED EMBODIMENT

Figure 1:
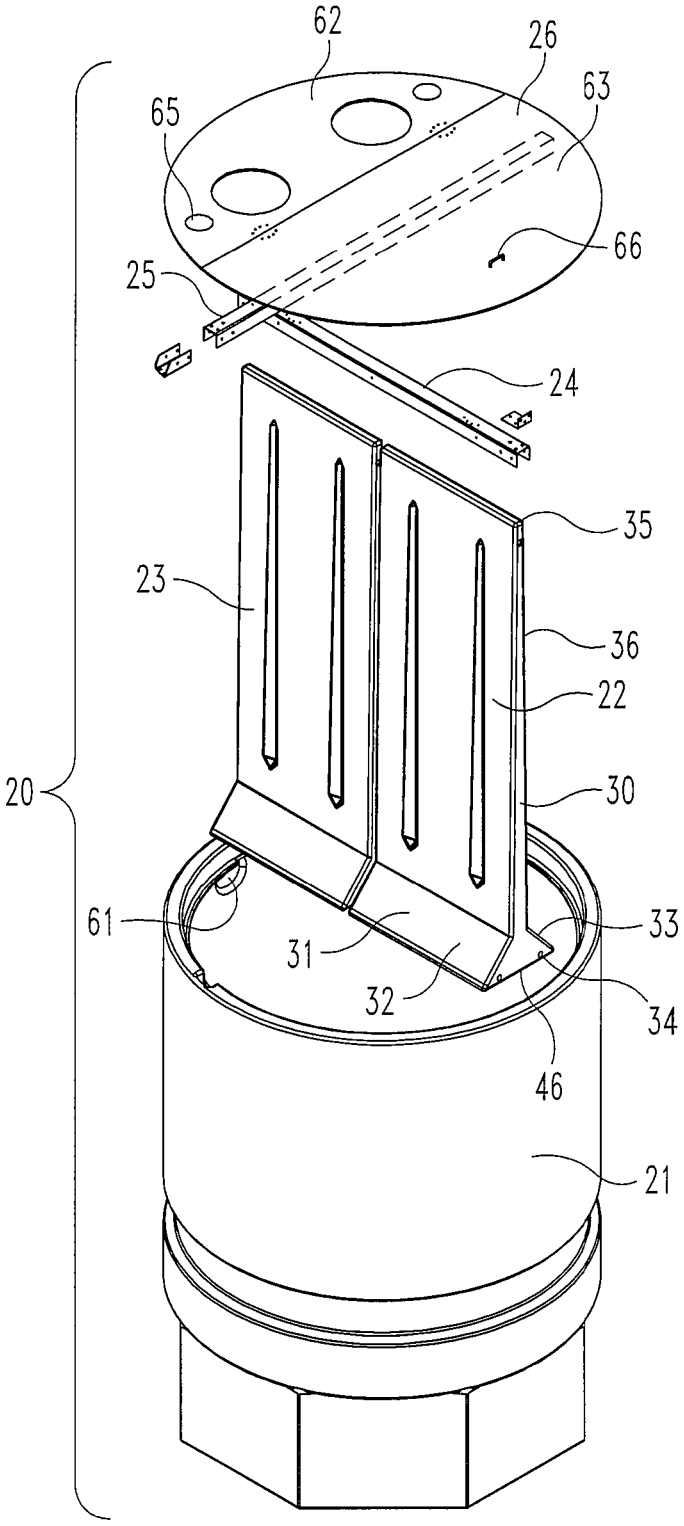
FIG. 1 is an exploded perspective view of a tank and baffle combination.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
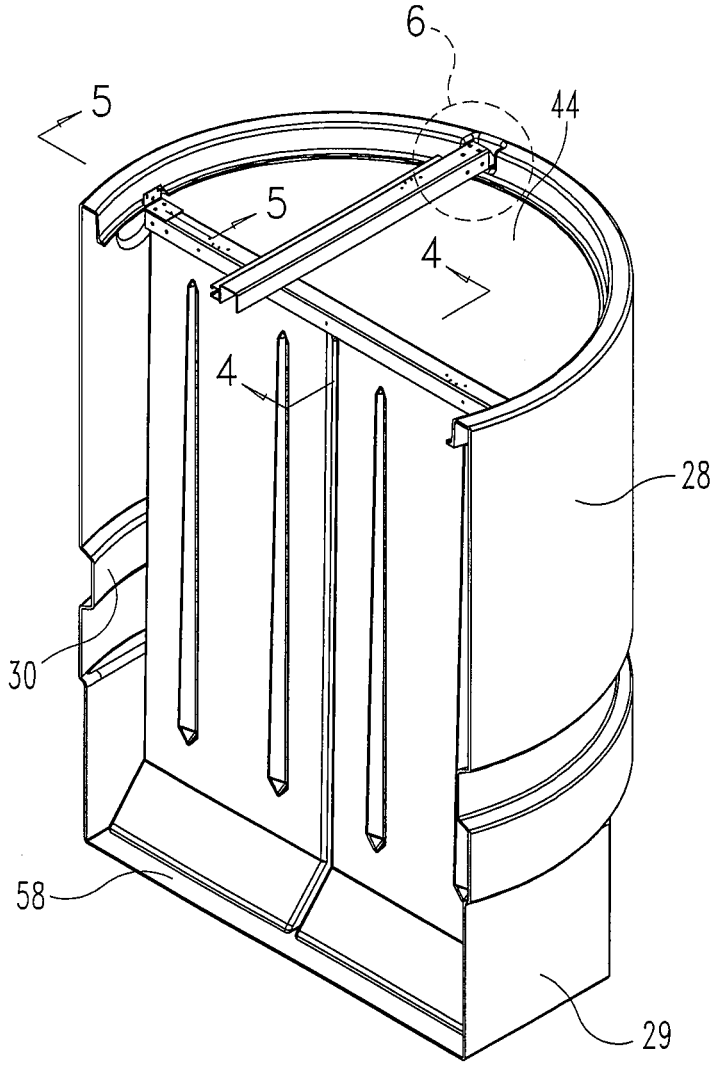
FIG. 2 is an enlarged cross-sectional view showing two baffles in place within the tank of FIG. 1.
Figure 3:
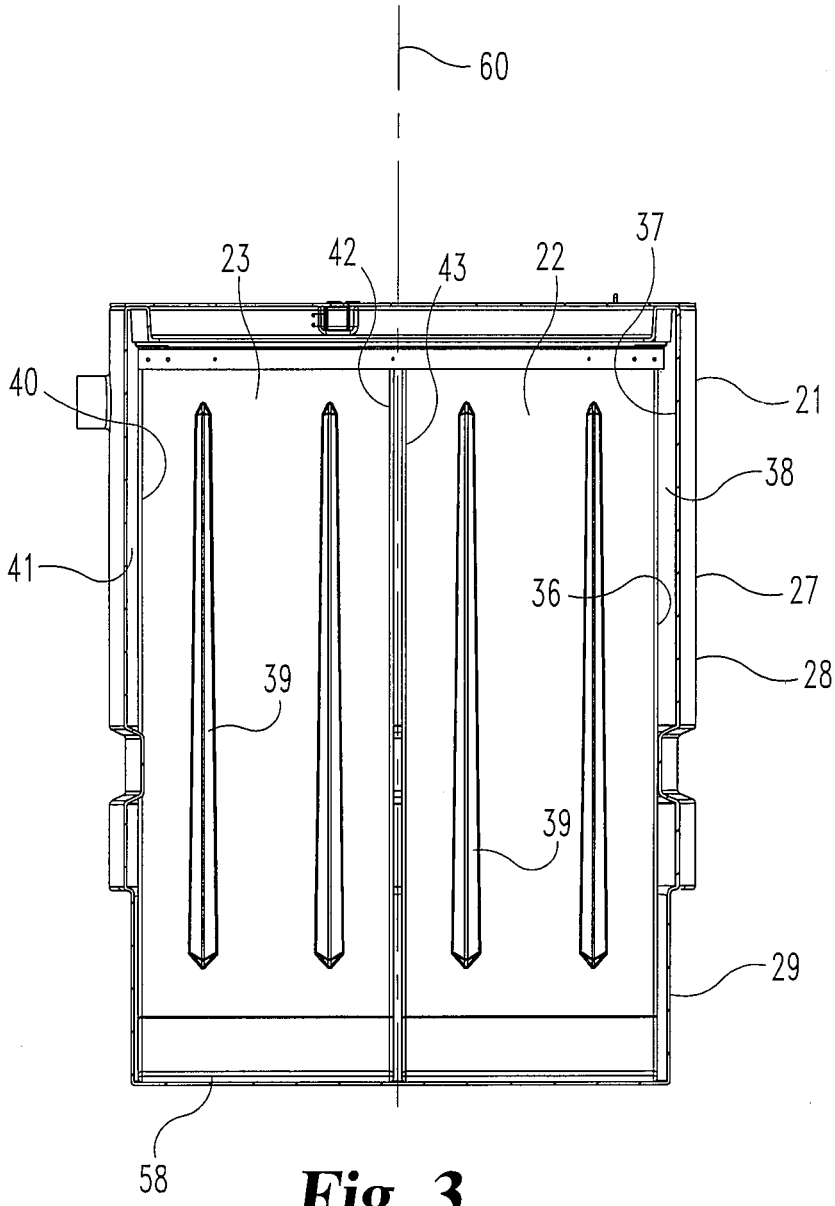
FIG. 3 is a side view of FIG. 2.

Referring now more particularly to FIG. 1, there is shown an exploded view of a tank 20 for holding liquid. Tank 20 consists of a main body 21 defining an interior cavity into which a pair of baffles or partitions 22 and 23 is positioned. The bottom end 31 of each partition 22 and 23 is flared. The top end 35 of the partitions are loosely received in a downwardly opening channel 24 that is secured to the side wall of the main body 21 of the tank. A cross member 25 is secured to the side wall of the main body 21 of the tank atop of which rest a lid 26. The tank has a vertical axis 60 (FIG. 3) that extends longitudinally from the tank bottom wall 58 through the top end and lid of the tank. The side wall 27 is connected to bottom wall 58 and together form the cavity 44 (FIG. 2) of the tank. Side wall 27 surrounds axis 60 and has an upper cylindrical configuration 28 (FIG. 2) joined by an inwardly projecting intermediate cylindrical configuration 30, in turn, joined to a lower polygonal configuration 29. The inside diameter defined by the inwardly projecting surface of intermediate configuration 30 is less than the inside diameter of the inwardly projecting surface of the upper cylindrical configuration 28 as well as the dimension of the opposite interior surfaces of the polygonal lower configuration 29. Thus, the longitudinally extending edge portions 36 and 40 (FIG. 3) of partitions 22 and 23 are spaced apart from the interior surfaces 37 of the upper configuration 28 and lower configuration 29 while being in contact with the interior surface of intermediate configuration 30. Partitions 22 and 23 divide the tank cavity into at least two separate areas, one on each side of the aligned partitions. The liquid within each area on either side of the partitions may be, for example, of a different temperature although the liquid is able to flow from one side of the partition to the other side of the partition in the gaps 38 and 41 existing between the longitudinally extending edge portions of the partitions and the interior surface of the upper cylindrical configuration 28. Likewise, gaps may be provided between the longitudinally extending edge portions 36 and 40 and the interior surface of the lower polygonal configuration 29.

In the embodiment shown in the drawings, partitions 22 and 23 are aligned. The middle longitudinally extending edge portions 42 and 43 (FIG. 3) of partitions 23 and 22 may be spaced apart or in contact with each other. In the event edge portions 42 and 43 are spaced apart then liquid from one side of the partitions may flow into the area on the opposite side of the partitions.

Many variations are contemplated and included in the present invention. For example, the two partitions or baffles shown in the drawings are depicted as being aligned; however, a single partition wall may be used to extend across the entire interior width of the tank cavity in lieu of two partitions. Likewise, more than two partitions may be installed within the tank in order to divide separate areas within the tank more than the two areas depicted on the opposite sides of the partitions in the drawings.

In order to provide for ease of assembly while increasing the stability of the partition relative to the tank, the bottom flared portion 31 (FIG. 1) of each partition is hollow allowing liquid within the tank to flow into the partition via passages 34.

Figure 4:
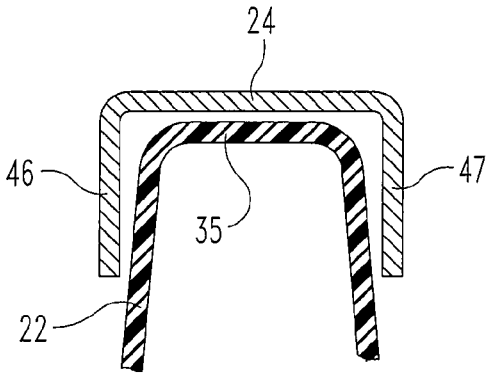
FIG. 4 is a fragmentary enlarged cross-sectional view taken along the line 4-4 of FIG. 2 and viewed in the direction of the arrows.

Partition 22 will now be described it being understood that an identical description applies to partition 23. Walls 32 and 33 of the flared bottom portion 31 of partition 22 diverge from the main body of the partition to the bottom wall 46 of the flared bottom portion 31. Side wall 30 extends upwardly from wall 46 joining together walls 32 and 33 with passages 34 extending through wall 30 into the hollow interior formed by bottom wall 46 and walls 30, 32 and 34. Thus, liquid may flow into the hollow interior of the flared bottom portion providing increased weight at the bottom of the partition. Bottom wall 46 extends a distance greater than the thickness of the main body of the partition. This increased distance or width of the flared bottom portion coupled with the increased weight of the flared bottom portion provides increased stability of the partition limiting the amount of relative motion, if any, existing between the partition bottom end and the bottom wall 58 of the tank. In order to hold the partition from unacceptable movement, the downwardly opening channel 24 (FIG. 4) extends over the top end 35 of partition 22 with the downwardly extending legs 46 and 47 being spaced apart a distance greater than the thickness of the top end 35 of the partition allowing only a limited, if any, movement between the partition and channel 24. While the top end of the partition is depicted as hollow in FIG. 4, the present invention includes a partition that is solid without any internal cavity existing between the downwardly extending opposite side walls of the partition until the partition flares out at bottom end portion 31. Partitions 22 and 23 extend in the direction of the longitudinal axis 60 of the tank. The downwardly extending channel 24 limits sideways movement of the top end 35 of the partitions relative to the longitudinal axis and the side wall of the tank. A plurality of vertically extending strengthening ribs or channels 39 (FIG. 3) are formed in the partitions adding to the strength of the partitions.

Figure 5:
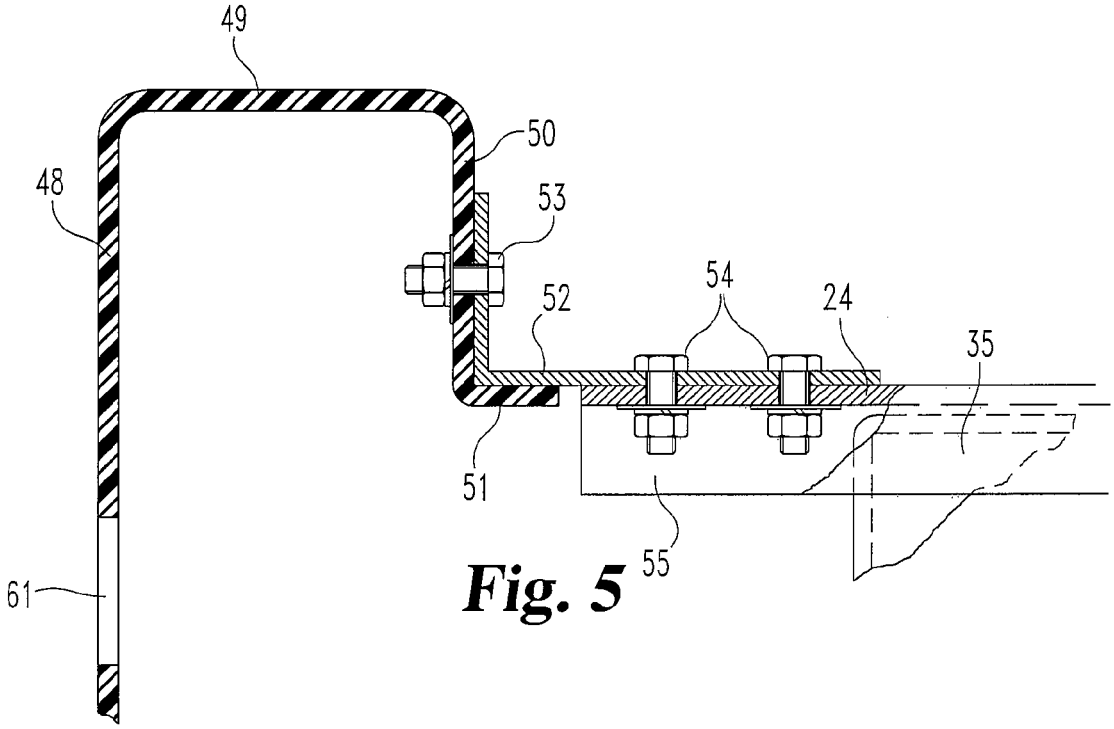
FIG. 5 is a fragmentary enlarged cross-sectional view taken along the line 5-5 of FIG. 2 and viewed in the direction of the arrows.

A rim is formed at the top end of the tank side wall to allow for the mounting of channel 24, cross member 25, and lid 26. The upper portion 48 (FIG. 5) of the tank side wall extends vertically and is integrally attached to a horizontal and inwardly extending portion 49 which is then integrally attached to a vertical and downwardly extending portion 50 (FIG. 5). An inwardly extending shelf 51 extends integrally from the bottom end portion of the downwardly extending wall portion 50 forming a seat upon which an L-shaped bracket 52 is mounted. The upwardly projecting portion of bracket 52 is fastened by a conventional bolt or other fastening means 53 to the downwardly extending portion 50 of the tank side wall with the horizontally extending portion of the bracket 52 extending inwardly of shelf 51 being attached to the horizontal and top wall of downwardly extending channel 24 by conventional fastening devices 54. Each end 55 of channel 24 is attached to the tank side wall by an L-shaped bracket and fastening device such as just described.

The side wall of the tank has an overflow outlet 61 that is located lower in elevation than the connection of channel 24 and cross-member 25 to the tank side walls thereby allowing for liquid within the tank to flow outward without first contacting the connections between the tank side wall and the downwardly extending channel or cross-member. Thus, the holding support, namely channel 24 is connected to the side wall of the tank at an elevation above the overflow outlet 61 limiting or preventing leakage from the tank main body via the connection of the partition holding support to the side wall.

Figure 6:
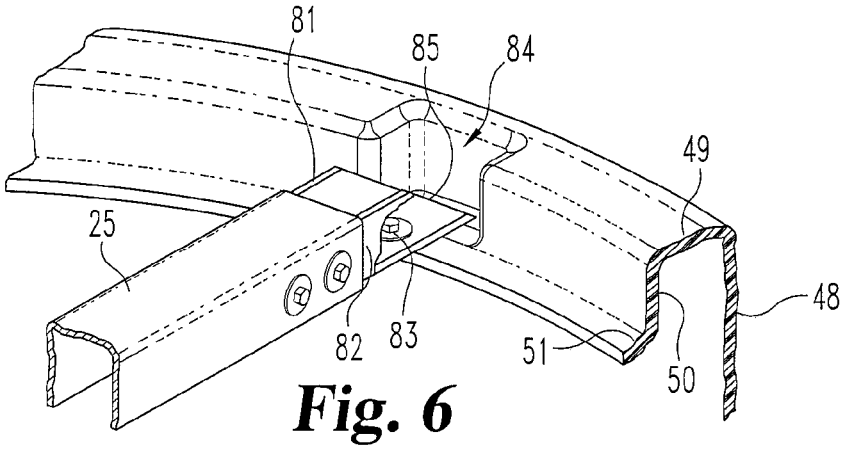
FIG. 6 is an enlarged perspective view of the cross member end enclosed in circle 6 of FIG. 2.

Cross-member 25 (FIG. 6) is provided for mounting lid 26 (FIG. 1) to the tank. Lid 26 includes a stationary portion 62 that mounts atop cross-member 25. A movable lid portion 63 is pivotally mounted to stationary portion 62 by conventional hinges and has a downwardly extending U-shaped handle 66 mounted to the movable portion to allow the lid to be opened and closed.

Apertures 65 are provided in stationary portion 62 through which standard fastening devices are extended through stationary portion 62 and into cross-member 25 fixedly securing the lid to the cross-member.

The opposite ends of cross-member 25 each have an upwardly opening U-shaped channel 81 (FIG. 6) with conventional fastening devices extending through the vertical side walls 82 of channel 81 and through the downwardly extending side walls of cross member 25 thereby fixedly securing cross-member 25 and channel 81 together. The rim of the container has a cutout portion forming a recess 84 into which channel 81 fits so that the bottom wall of the upwardly opening channel 81 fits atop shelf 51. The distal edge 85 of channel 81 is beveled with the edge adjacent the bottom wall of channel 81 extending away from the container rim to the top edge of channel 81. Conventional fastening devices 83 are extended through the horizontal bottom wall of channel 81 and through shelf 51 of the side wall thereby fixedly securing each channel 81 and thus cross-member 25 to the side wall of the tank. The lid is then fixedly secured to the horizontally extending wall of channel 25. Notably, cross-member 25 is positioned above and spaced apart from channel 24 (FIG. 1) thereby providing a lid support while limiting downward lid force on channel 24.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A tank with internal baffle comprising:

a main body including a bottom wall and a side wall connected together forming an internal tank cavity;

a first baffle wall having a first top end and a first enlarged flared bottom portion resting atop said bottom wall to limit sideways movement of said baffle wall atop said bottom wall; and, a holding support secured to said side wall and said top end of said baffle wall limiting sideways movement of said top end relative to said side wall, and wherein:

said main body has a vertically extending longitudinal axis with said side wall surrounding said axis, said holding support has opposite ends fastened to said side wall;

said baffle wall extends in the direction of said axis from said bottom wall to said holding support dividing said cavity into multiple chambers, and said holding support is a downwardly opening channel loosely receiving said top end of said baffle wall allowing limited movement of said top end within said channel; and further comprising:

a cross support with opposite ends secured to said side wall, said cross support located above said holding support and providing a lid support while limiting downward lid force on said holding support.

2. The tank of claim 1 and further comprising a lid restable atop said cross support.

3. The tank of claim 1 and further comprising:

a second baffle wall having a second top end and a second enlarged flared bottom portion resting atop said bottom wall to limit sideways movement of said second baffle wall atop said bottom wall.

4. The tank of claim 3 wherein:

said first baffle wall and said second baffle wall are aligned with said first top end and said second top end received in said holding support dividing said cavity into two chambers.

5. The tank of claim 1 wherein:

said main body has an overflow outlet limiting the level of liquid within said main body, said holding support is connected to said side wall at an elevation above said overflow outlet limiting leakage from said main body via the connection of said holding support to said side wall.

6. A tank with internal baffle comprising:

a main body including a bottom wall and a side wall connected together forming an internal tank cavity;

a first baffle wall having a first top end and a first enlarged flared bottom portion resting atop said bottom wall to limit sideways movement of said baffle wall atop said bottom wall; and, a holding support secured to said side wall and said top end of said baffle wall limiting sideways movement of said top end relative to said side wall; and wherein:

said side wall of said main body has an upper cylindrical configuration, an intermediate cylindrical configuration of an inside diameter less than said upper cylindrical configuration and a lower polygonal configuration joined together; and, said intermediate cylindrical configuration projects inwardly of said upper cylindrical configuration engaging said first baffle wall.

7. The combination of:

a tank to hold liquid and having a vertical axis, a bottom wall and a continuous side wall connected to said bottom wall and surrounding said vertical axis defining a tank cavity;

a vertically extending dividing partition within said tank creating multiple areas within said tank, said partition having a hollow portion allowing liquid within said tank to flow into said partition; and, a bracket mounted to said tank and engaged with said partition to limit movement of said partition with said tank; and wherein:

said partition includes a flared bottom portion that is hollow to receive said liquid stabilizing movement of said partition relative to said tank;

said partition has vertically extending edge portions at least some of which are spaced apart from said side wall allowing liquid flow from an area on one side of said partition to an area on another side of said partition.

8. The combination of claim 7 wherein:

said edge portions in part in contact with said side wall limiting movement of said partition with said side wall.

9. A tank with internal baffle comprising:

a main body including a bottom wall and a side wall connected together forming an internal tank cavity;

a first baffle wall having a first top end and a first enlarged flared bottom portion resting atop said bottom wall to limit sideways movement of said baffle wall atop said bottom wall; and, a holding support secured to said side wall and said top end of said baffle wall limiting sideways movement of said top end relative to said side wall, and wherein:

said holding support is a downwardly opening channel loosely receiving said top end of said baffle wall allowing limited movement of said top end within said channel; and further comprising:

a cross support with opposite ends secured to said side wall, said cross support located above said holding support and providing a lid support while limiting downward lid force on said holding support.

* * * * *